United States Patent [19]

Pasmannik et al.

[11] 4,392,079

[45] Jul. 5, 1983

[54] METHOD OF ADJUSTING PHASE SHIFT IN AMPLIFICATION MULTICAVITY KLYSTRON AND DEVICE THEREFOR

[76] Inventors: Vitaly I. Pasmannik, ulitsa Ostrovityanova, 45, korpus 1, kv. 569, Moscow; Viktor P. Sakharov, Leninsky raion, poselok Mosrentgen, 29, kv. 50, Moskovskaya oblast, both of U.S.S.R.

[21] Appl. No.: 201,061

[22] PCT Filed: Oct. 24, 1979

[86] PCT No.: PCT/SU79/00100

§ 371 Date: Aug. 12, 1980

§ 102(e) Date: Aug. 11, 1980

[87] PCT Pub. No.: WO80/01332

PCT Pub. Date: Jun. 26, 1980

[30] Foreign Application Priority Data

Dec. 12, 1978 [SU] U.S.S.R. ..... 2695744

[51] Int. Cl.[3] ..... H01J 25/10

[52] U.S. Cl. ..... 315/5.39; 315/5.44; 315/5.45

[58] Field of Search ..... 315/5.44, 5.45, 5.41, 315/5.42, 5.39; 330/43

[56] References Cited

U.S. PATENT DOCUMENTS

| | | | |
|---|---|---|---|
| 2,424,959 | 8/1947 | Alford | 315/5.44 X |
| 2,445,811 | 7/1948 | Varian | 315/5.45 X |
| 2,487,800 | 11/1949 | Hansen | 315/5.45 X |
| 2,559,730 | 7/1951 | Norton | 315/5.45 X |
| 2,883,536 | 4/1959 | Salisbury et al. | 315/5.41 X |
| 2,922,921 | 1/1960 | Nygard | 315/5.42 |
| 2,960,658 | 11/1960 | Dain et al. | 315/5.44 X |
| 3,264,568 | 8/1966 | Goerz, Jr. et al. | 315/5.41 |
| 4,041,413 | 8/1977 | Strother, Jr. | 330/43 |

FOREIGN PATENT DOCUMENTS

| | | | |
|---|---|---|---|
| 358762 | 12/1972 | U.S.S.R. | 315/5.38 |

*Primary Examiner*—Saxfield Chatmon, Jr.
*Attorney, Agent, or Firm*—Fleit, Jacobson & Cohn

[57] ABSTRACT

A method of adjusting a phase shift in an amplification multicavity klystron comprises the steps of tapping a portion of signal from output and intermediate resonators of a klystron, adding up the tapped signals, adjusting the amplitudes and phases of the tapped signals so that said signals have equal amplitude but opposite phases with the klystron operating under nominal conditions and applying the sum signal to an input resonator whereupon anode voltage is varied until a phase shift in the klystron changes, the subsequent step being the selection of the phase of the sum signal to provide for a minimum phase-shift variation in the klystron. A device for executing the proposed method of adjusting a phase shift includes a line composed of a phase shifter, an adder, and an additional phase shifter. One input of the phase shifter is connected to the output resonator of the klystron, while the other input thereof is coupled to the adder. The additional phase shifter is connected to the input resonator of the klystron and to the adder, whereas the adder is coupled to the phase shifters and to the intermediate resonator of the klystron.

2 Claims, 3 Drawing Figures

METHOD OF ADJUSTING PHASE SHIFT IN AMPLIFICATION MULTICAVITY KLYSTRON AND DEVICE THEREFOR

FIELD OF THE INVENTION

The present invention relates to electronic engineering and in particular to a method of adjusting a phase shift in an amplification multicavity klystron and a device therefor.

PRIOR ART

At the present time a phase shift of O-type amplifiers is normally stabilized by regulating power sources, particularly anode voltage sources which influence the phase shift value more markedly. So, for example, a 1% variation of anode voltage causes the phase shift of an output signal to change by tens of degrees in travelling-wave tubes and by ten or more degrees in a klystron, depending on the operating frequency band and mu factor. In stabilizing the phase shift by regulating power sources, an anode voltage stability of about $10^{-4}$ is required to obtain a phase-shift stability of some 0.1° in modern radars. Considerable difficulties are encountered in providing such stability of anode voltage, particularly in pulsed operation with devices having a variable on-off ratio, a disadvantage generally resulting in increased dimensions and weight of an anode voltage source.

Known in the art are methods of enhancing stability of a phase shift in O-type devices, which permit obtaining desired stability with medium anode voltage regulation levels.

Another known method involves correction of phase differences in travelling-wave tubes operating in parallel (cf. U.S. Pat. No. 3,958,184, Cl.328-155, 1976). The aforesaid method comprises the steps of tapping a portion of an output signal from an amplifier, comparing the output signal with a signal derived from a reference system, obtaining voltage proportional to a difference in phases of the signals being compared, and utilizing said voltage for controlling a phase-shifter located ahead of the input of a travelling-wave tube. The aforesaid method has been generally unsatisfactory due to low response attributed to the operation of an a-f feedback circuit and its intricate structure, a factor substantially limiting the field of its applications.

The prototype of the hereinproposed method of adjusting a phase shift in a klystron is a known method employing negative feedback between the output and input of a klystron (cf. "Automatic Phase Incursion Control in Amplifiers" edited by M. V. Kapranov, "Soviet Radio" publishers, Moscow, 1972), wherein a portion of the output signal power is fed to the input of the klystron in antiphase with the input signal. The operating speed provided by such a method equals several r-f oscillation periods, a value high enough as compared with the rise time of signals in radio sets. Another advantage of the foregoing method is a comparatively simple feedback circuit.

However, the process of enhancing phase-shift stability in the device is accompanied by corresponding decreases in the mu factor, a disadvantage associated with the fact that the feedback signal voltage is subtracted from the input signal voltage. The fuller the compensation of phase instability of the device, the higher will be the losses in the mu factor.

The known device for accomplishing the aforesaid method of adjusting a phase shift by employing negative feedback between the output and input of a klystron comprises a line for transmitting a signal from an output resonator to an input resonator of said klystron, a phase shifter for adjusting the phase of a signal applied to the input resonator and, if required, a filter for preventing self-oscillations at frequencies corresponding to positive feedback.

DISCLOSURE OF THE INVENTION

The invention resides in providing a method of adjusting a phase shift in an amplification multicavity klystron and a device therefor, which make it possible to prevent any change in a phase shift in a klystron in the case of anode voltage variations as small as a few percent without losses in the mu factor. The method is accomplished by employing two feedback channels.

The foregoing object is attained by providing a method of adjusting a phase shift in an amplification multicavity klystron involving the tapping of a portion of a signal from an output resonator, wherein according to the invention, the following additional steps are carried out tapping a portion of signal from an intermediate resonator, adding up the signals tapped from the output and intermediate resonators, applying the sum signal to an input resonator of the klystron, and adjusting the amplitudes and phases of the tapped signals so that the tapped signals have equal amplitudes but opposite phases, whereupon anode voltage is varied until the phase shift in the klystron changes, the subsequent step being the selection of the phase of the sum signal so as to provide a minimum phase-shift variation in the klystron.

Since with operating anode voltage a signal fed to the input resonator from the adder is zero, the input power and mu factor of the klystron will be essentially the same as in a device having no feedback circuits. The phase-shift compensation level with a slight variation of the operating voltage depends on the values of signals tapped from the output and intermediate resonators. The signal value corresponding to full phase-shift compensation is determined by the ratio between distances from the intermediate resonator to the input and output resonators. With a smaller value of the tapped signals it is possible to partially adjust the phase shift, while a greater value of the tapped signals enables the phase shift opposite to the phase shift in klystrons having no feedback circuits.

The foregoing object is also accomplished by providing that, in a device for executing the proposed method, a phase shift in an amplification multicavity klystron is provided, and the device includes a line for transmitting a signal from an output resonator to an input resonator of said klystron through a phase shifter, and, according to the invention, said line incorporates a signal adder coupled to the intermediate and input resonators, while an additional phase shifter is inserted between the adder and the input resonator to provide for selection of the phase of an adjusting signal.

BRIEF DESCRIPTION OF THE DRAWINGS

The invention will now be described further with reference to specific embodiments thereof, taken in conjunction with the accompanying drawings, wherein.

PREFERRED EMBODIMENT OF THE INVENTION

Figure 1:
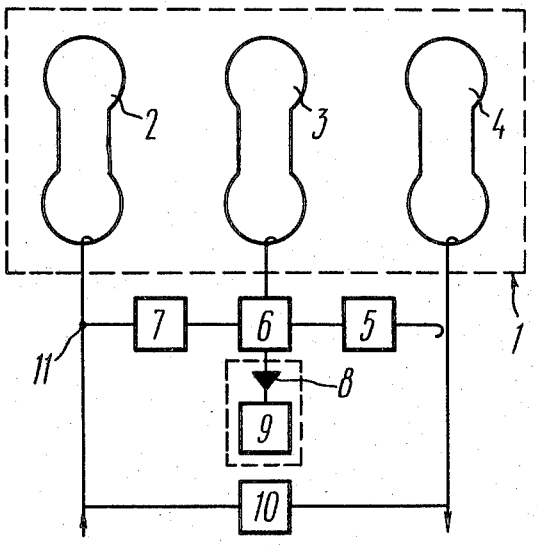
FIG. 1 depicts a device for executing a method of adjusting a phase shift in an amplification multicavity klystron according to the invention.

Referring to the drawings the device for adjusting a phase shift in an amplification klystron 1 (FIG. 1), comprises an input resonator 2, an intermediate resonator 3, an output resonator 4, a line composed of a phase shifter 5 whose output is connected to one input of an adder 6, and an additional phase shifter 7 connected to a second input to the adder. The input of the phase shifter 5 is coupled to the output resonator 4, whereas the additional phase shifter 7 is connected to the input resonator 2 of the klystron 1. A third input of the adder 6 is connected to the intermediate resonator 3, while a fourth input thereof is coupled through a detector 8 to an indicator 9 indicating the signal level in the adder 6. Besides, a phase meter 10 is placed between the input and output resonators 2 and 4 of the klystron 1 during an alignment procedure.

It is essential that one of the coupling elements feeding a portion of power from the output resonator 4 and from the intermediate resonator 3 of the klystron 1 to the adder 6, say, the element for coupling with the output resonator 4, should be adjustable as regards a transmitted power level. The adjustment may also be accomplished by placing a variable attenuator ahead of the adder 6. The adder 6 may represent a T-element with an additional lead for the signal level indicator 9 or a cavity resonator having four leads. If the adder 6 is a T-element, a cavity resonator or a narrowband filter with two leads may be placed in the line between the adder 6 and the input resonator 2 of the klystron 1. The indicator 9 indicating the signal level in the adder may also be mounted at any point of the line. Decoupling elements may be inserted in the line to prevent the reflection effect.

The device may be aligned by the following method:

- disconnecting a coupling element 11 if no decoupling element is placed in the line between the adder 6 and the input resonator 2 of the klystron 1;
- adjusting alternately the coupling with the output resonator 4 and the phase shifter 5 so that the signals in the adder 6 fed from the output and intermediate resonators 4 and 3 have equal amplitudes but opposite phases (in this case, the r-f signal in the adder 6 is zero and the indicator 9 signalling signal level in the adder 6 reads zero);
- connecting the additional phase shifter 7 to the input resonator 2;
- measuring the phase shift in the klystron 1 with the phase meter 9 under nominal operating conditions; and
- varying anode voltage and adjusting the additional phase shifter 7 so as to provide a minimum phase-shift variation in the klystron 1.

The method of adjusting a phase shift in the amplification multicavity klystron 1 involving the tapping of a portion of signal from the output resonator 4 comprises the additional steps of tapping a portion of the signal from the intermediate resonator 3, adding up the signals from the output and intermediate resonators 4 and 3, adjusting the phase and amplitude of one of the tapped signals, say, the phase and amplitude of the signal fed from the output resonator 4 to the adder 6, by the use of the phase shifter 5, and varying the coupling with the output resonator 4 so that the amplitude of the signal in the adder 6 fed from the output resonator 4 is equal to the amplitude of the signal applied from the intermediate resonator 3, while the phases of said signals are opposite. The amplitude and phase selection is correct if the indicator 9 reads zero level of the r-f signal in the adder 6.

After the amplitudes and phases of the signals tapped from the output and intermediate resonators 4 and 3 have been selected, the sum signal from the adder 6 is fed to the input resonator 2 of the klystron 1. The next step is to vary the anode voltage. Changing the phase of the signals from the output and intermediate resonators 4 and 3 of the klystron 1 will cause the sum signal in the adder 6 to differ from zero and an additional adjusting signal will appear at the input resonator 2. Changing the phase of the adjusting signal at the input resonator 2 of the klystron 1 with the additional phase shifter 7 so that the phase shift change in the klystron 1 due to the anode voltage variation is set to a minimum, it will be possible to provide optimum adjustment of phase-shift instability and restore the nominal operating voltage.

Figure 2:
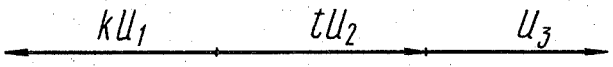
FIG. 2 is a vector diagram illustrating r-f voltages in an input resonator with anode voltage corresponding to nominal operating conditions of a klystron according to the invention.
Figure 3:
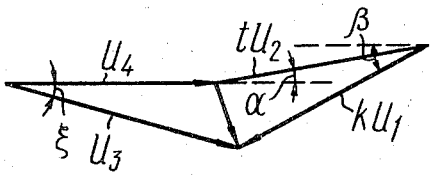
FIG. 3 is a vector diagram illustrating r-f voltages in an input resonator with varying anode voltage.

The following symbols are used on the vector diagrams of FIGS. 2 and 3 illustrating the preferred embodiment of the invention:

- $U_1$=r-f voltage at the output resonator 4 of the klystron 1;
- $U_2$=r-f voltage at the intermediate resonator 3 of the klystron 1;
- $U_3$=r-f voltage at the input resonator 2 of the klystron 1;
- $U_4$=r-f voltage at the input resonator 2 of the klystron 1 without feedback furnished by an input power source;
- $U_5$=adjusting r-f signal fed from the adder 6 to the input resonator 2 with anode voltage variations; and
- k and t=coefficients of transmission of r-f voltages from the output and intermediate resonators 4 and 3 to the input resonator 2 of the klystron 1 with account for phase delays in the transmission line.

With the above configuration of the device for adjusting a phase shift, under nominal operating conditions (FIG. 2) when $kU_1=-tU_2$, the adjusting signal $U_5=O$ and the r-f voltage at the input resonator 2 (FIG. 1) of the klystron 1 will be determined solely by the input power source $U_3=U_4$ (FIG. 2) and the mu factor of the klystron 1 (FIG. 1) will be equal to the mu factor of the klystron 1 without feedback.

In the event of any variation resulting in a change of the phase of the output signal by an angle $\beta$ (FIG. 3), the phase of the signal in the intermediate resonator 3 (FIG. 1) will change by a value $\alpha$ (FIG. 3) since the distance from the input resonator 2 to the intermediate resonator 3 (FIG. 1) is smaller than the distance from said intermediate resonator to the output resonator 4. Actually, a phase shift $\phi$ (FIG. 3) of the r-f voltages at the resonators 2, 3, and 4 (FIG. 1) arranged along the klystron 1 is determined by the following relationship:

$$\phi = \frac{2\pi f l}{\sqrt{2\frac{e}{m}U_o}} \quad (1)$$

where f=operating frequency;

l=distance from the input resonator 2;

m/e=ratio of charge to electron mass;

$U_o$=anode voltage of the klystron 1.

From the equation (1) it follows that a greater distance corresponds to a larger phase shift as the anode voltage of the klystron 1 is varied. Referring to the vector diagram of FIG. 3 illustrating operation of the klystron 1 under the conditions differing from the rated mode it is seen that $kU_1 \neq -tU_2$ and the input resonator 2 (FIG. 1) of the klystron 1 accepts the adjusting voltage signal $U_5$ from the adder 6. In this case, $U_3 \neq U_4$ (FIG. 3) and the signal voltage at the input resonator 2 (FIG. 1) of the klystron is phase-shifted with respect to the voltage of the input power source through an angle $\xi$ (FIG. 3) in the direction opposite to that of the input signal phase variation. The phase of the output signal will, thus, be adjusted. With a sufficiently high level of the tapped signals it is possible to obtain such an adjusting voltage $U_5$, that $\xi=\beta$ and the phase shift instability is fully compensated.

Inasmuch as the phase of the adjusting voltage is shifted through 90° with respect to the voltage at the input resonator 2 (FIG. 1), the value of said voltage will change but slightly with varying anode voltage of the klystron 1. The mu factor of the klystron 1 will also be unchanged.

The use of a cavity resonator or a narrowband filter prevents spurious oscillations from occurring at unwanted frequencies.

The method according to the invention makes the requirements for power source stability less stringent, an advantage decreasing, in its turn, dimensions, weight and cost of power sources of the klystron 1.

Industrial Use

The invention may be used in radio equipment wherein the phase of amplified signals should have increased stability, say, in transmitters of radar sets incorporating an MTI circuit, high-power charged-particle accelerators supplied with r-f signals, and in other devices, in which a multicavity klystron is used as an r-f energy source.

We claim:

1. A method of adjusting a phase shift in an amplification multicavity klystron including an input resonator, an intermediate resonator and an output resonator, said method comprising the steps of:

tapping a portion of a signal from the output resonator;

tapping a portion of a signal from the intermediate resonator;

adding the signals tapped from the output and intermediate resonators to obtain a sum signal;

applying the sum signal to the input resonator of the klystron; and adjusting amplitudes and phases of the tapped signals so that the tapped signals have equal amplitudes but opposite phases;

wherein anode voltage is varied until the phase shift in the klystron changes, and comprising the subsequent step of selecting the phase of the sum signal so as to provide a minimum phase-shift variation in the klystron.

2. A device for adjusting a phase shift in an amplification klystron, comprising an input resonator, an intermediate resonator, an output resonator, and means for transmitting a signal from the output resonator to the input resonator of said klystron, said means for transmitting comprising a phase shifter, a signal adder coupled to the phase shifter, the intermediate resonator and the output resonator, and an additional phase shifter inserted between the adder and the input resonator to provide for selection of the phase of an adjusting signal.

* * * * *